US008075256B2

(12) United States Patent
Little

(10) Patent No.: US 8,075,256 B2
(45) Date of Patent: Dec. 13, 2011

(54) INGESTION RESISTANT SEAL ASSEMBLY

(75) Inventor: David A. Little, Chuluota, FL (US)

(73) Assignee: Siemens Energy, Inc., Orlando, FL (US)

( * ) Notice: Subject to any disclaimer, the term of this patent is extended or adjusted under 35 U.S.C. 154(b) by 415 days.

(21) Appl. No.: 12/432,061

(22) Filed: Apr. 29, 2009

(65) Prior Publication Data

US 2010/0074733 A1 Mar. 25, 2010

Related U.S. Application Data

(60) Provisional application No. 61/100,042, filed on Sep. 25, 2008.

(51) Int. Cl.
*F01D 25/24* (2006.01)

(52) U.S. Cl. ..... 415/173.7; 415/173.1; 415/173.5; 415/180; 415/230

(58) Field of Classification Search ..... 415/173.1, 415/173.5, 173.7, 180, 230
See application file for complete search history.

(56) References Cited

U.S. PATENT DOCUMENTS

| | | | | |
|---|---|---|---|---|
| 3,647,311 | A | 3/1972 | Wootton et al. | |
| 4,425,079 | A | 1/1984 | Speak et al. | |
| 5,503,528 | A | 4/1996 | Glezer et al. | |
| 5,967,745 | A | 10/1999 | Tomita et al. | |
| 6,152,690 | A | 11/2000 | Tomita et al. | |
| 6,189,891 | B1 | 2/2001 | Tomita et al. | |
| 6,217,279 | B1 | 4/2001 | Ai et al. | |
| 6,506,016 | B1 | 1/2003 | Wang | |
| 6,558,114 | B1 | 5/2003 | Tapley et al. | |
| 6,854,736 | B2 | 2/2005 | Paprotna | |
| 7,059,829 | B2 | 6/2006 | Garner | |
| 7,234,918 | B2 | 6/2007 | Brillert et al. | |
| 7,500,824 | B2 * | 3/2009 | Cheng et al. | 415/173.4 |
| 2007/0025836 | A1 * | 2/2007 | Nichols et al. | 415/115 |
| 2007/0059163 | A1 | 3/2007 | Tiemann | |

OTHER PUBLICATIONS

U.S. Appl. No. 12/022,302, filed Jan. 30, 2008, Diakunchak.
U.S. Appl. No. 12/355,878, filed Jan. 19, 2009, Liang.
U.S. Appl. No. 12/416,423, filed Apr. 1, 2009, Little.

* cited by examiner

*Primary Examiner* — Edward Wojciechowicz

(57) ABSTRACT

A seal assembly limits gas leakage from a hot gas path to one or more disc cavities in a gas turbine engine. The seal assembly includes a seal apparatus associated with a blade structure including a row of airfoils. The seal apparatus includes an annular inner shroud associated with adjacent stationary components, a wing member, and a first wing flange. The wing member extends axially from the blade structure toward the annular inner shroud. The first wing flange extends radially outwardly from the wing member toward the annular inner shroud. A plurality of regions including one or more recirculation zones are defined between the blade structure and the annular inner shroud that recirculate working gas therein back toward the hot gas path.

20 Claims, 5 Drawing Sheets

INGESTION RESISTANT SEAL ASSEMBLY

CROSS-REFERENCE TO RELATED APPLICATION

This application claims the benefit of U.S. Provisional Application Ser. No. 61/100,042, entitled INGESTION RESISTANT RIM SEAL, filed Sep. 25, 2008, the entire disclosure of which is incorporated by reference herein.

This invention was made with U.S. Government support under Contract Number DE-FC26-05NT42644 awarded by the U.S. Department of Energy. The U.S. Government has certain rights to this invention.

FIELD OF THE INVENTION

The present invention relates generally to a seal assembly for use in a turbine engine, and more particularly, to a seal assembly that limits leakage from a hot gas passage to one or more disc cavities in the turbine engine.

BACKGROUND OF THE INVENTION

In multistage rotary machines used for energy conversion, such as a gas turbine engine, a hot working fluid is used to produce rotational motion. In a gas turbine engine, air is compressed in a compressor and mixed with a fuel in a combustor. The mixture of gas and fuel is then ignited to create a working gas comprising hot combustion gases that is directed to turbine stage(s) to produce rotational motion. Both the turbine stage(s) and the compressor have stationary or non-rotary components, such as vanes, for example, that cooperate with rotatable components, such as rotor blades, for example, for compressing and expanding the working gas. Many components within the machines must be cooled by cooling air to prevent the components from overheating.

Leakage of the working gas from a hot gas path to one or more disc cavities in the machines reduces performance and efficiency. Working gas leakage into the disc cavities yields higher disc and blade root temperatures and may result in reduced performance, reduced service life and/or failure of the components in and around the disc cavities.

SUMMARY OF THE INVENTION

In accordance with a first aspect of the invention, a seal assembly is provided that limits gas leakage from a hot gas path to one or more disc cavities in a gas turbine engine comprising a plurality of stages, each stage comprising a plurality of stationary components and a disc structure supporting a blade structure comprising a row of airfoils for rotation on a turbine rotor. The seal assembly comprises a seal apparatus that limits gas leakage from the hot gas path to a disc cavity associated with an axially facing side of the blade structure. The seal apparatus comprises an annular inner shroud associated with adjacent stationary components, a wing member, and a first wing flange. The annular inner shroud comprises a radially inwardly facing side and a radially outwardly facing side. The wing member extends axially from the axially facing side of the blade structure toward the annular inner shroud and includes a radially inner side and a radially outer side. The first wing flange extends radially outwardly from the radially outer side of the wing member toward the radially inwardly facing side of the annular inner shroud. The first wing flange is curved in a radial direction and has a concave first surface facing the axially facing side of the blade structure and a second surface opposed from its concave first surface that faces away from the axially facing side of the blade structure. A radially outer edge of the first wing flange is located proximate to the radially inwardly facing side of the annular inner shroud such that a radial first gap having a dimension in the radial direction is formed between the first wing flange and the radially inwardly facing side of the annular inner shroud. An outer region is defined radially inwardly from the hot gas path between the axially facing side of the blade structure, the annular inner shroud, the radially outer side of the wing member, and the concave first surface of the first wing flange. A central region adjacent the outer region is defined between the wing member and the radially inwardly facing side of the annular inner shroud, and located adjacent to the second surface of the first wing flange. The concave first surface of the first wing flange limits a passage of working gas in the outer region through the radial first gap into the central region by recirculating at least a portion of the working gas in the outer region away from the radial first gap and back toward the hot gas path.

In accordance with a second aspect of the invention, a seal assembly is provided that limits gas leakage from a hot gas path to one or more disc cavities in a gas turbine engine comprising a plurality of stages, each stage comprising a plurality of stationary components and a disc structure supporting a blade structure comprising a row of airfoils for rotation on a turbine rotor. The seal assembly comprises a seal apparatus that limits gas leakage from the hot gas path to a disc cavity associated with an axially facing side of the blade structure. The seal apparatus comprises an annular inner shroud associated with adjacent stationary components, a wing member, a first wing flange, a second wing flange, and an axial shroud flange. The annular inner shroud comprises a radially inwardly facing side, a radially outwardly facing side, and an axially facing side. The wing member extends axially from the axially facing side of the blade structure toward the annular inner shroud and includes a radially inner side and a radially outer side. The first wing flange extends radially outwardly from the radially outer side of the wing member toward the radially inwardly facing side of the annular inner shroud. The first wing flange is curved in a radial direction and has a concave first surface facing the axially facing side of the blade structure and a second surface opposed from its concave first surface that faces away from the axially facing side of the blade structure. A radially outer edge of the first wing flange is located proximate to the radially inwardly facing side of the annular inner shroud such that a radial first gap having a dimension in the radial direction is formed between the first wing flange and the radially inwardly facing side of the annular inner shroud. The second wing flange is axially spaced apart from the first wing flange and extends radially outwardly from the radially outer side of the wing member toward the radially inwardly facing side of the annular inner shroud. The second wing flange is curved in the radial direction and has a concave first surface facing the axially facing side of the blade structure and a second surface opposed from its concave first surface and facing away from the axially facing side of the blade structure. A radially outer edge of the second wing flange is located proximate to the radially inwardly facing side of the annular inner shroud such that a radial second gap having a dimension in the radial direction is formed between the second wing flange and the radially inwardly facing side of the annular inner shroud. The axial shroud flange extends from the axially facing side of the annular inner shroud toward the wing member and is located proximate to the wing member such that an axial third gap having a dimension in an axial direction is formed between the axial shroud flange and the wing member.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
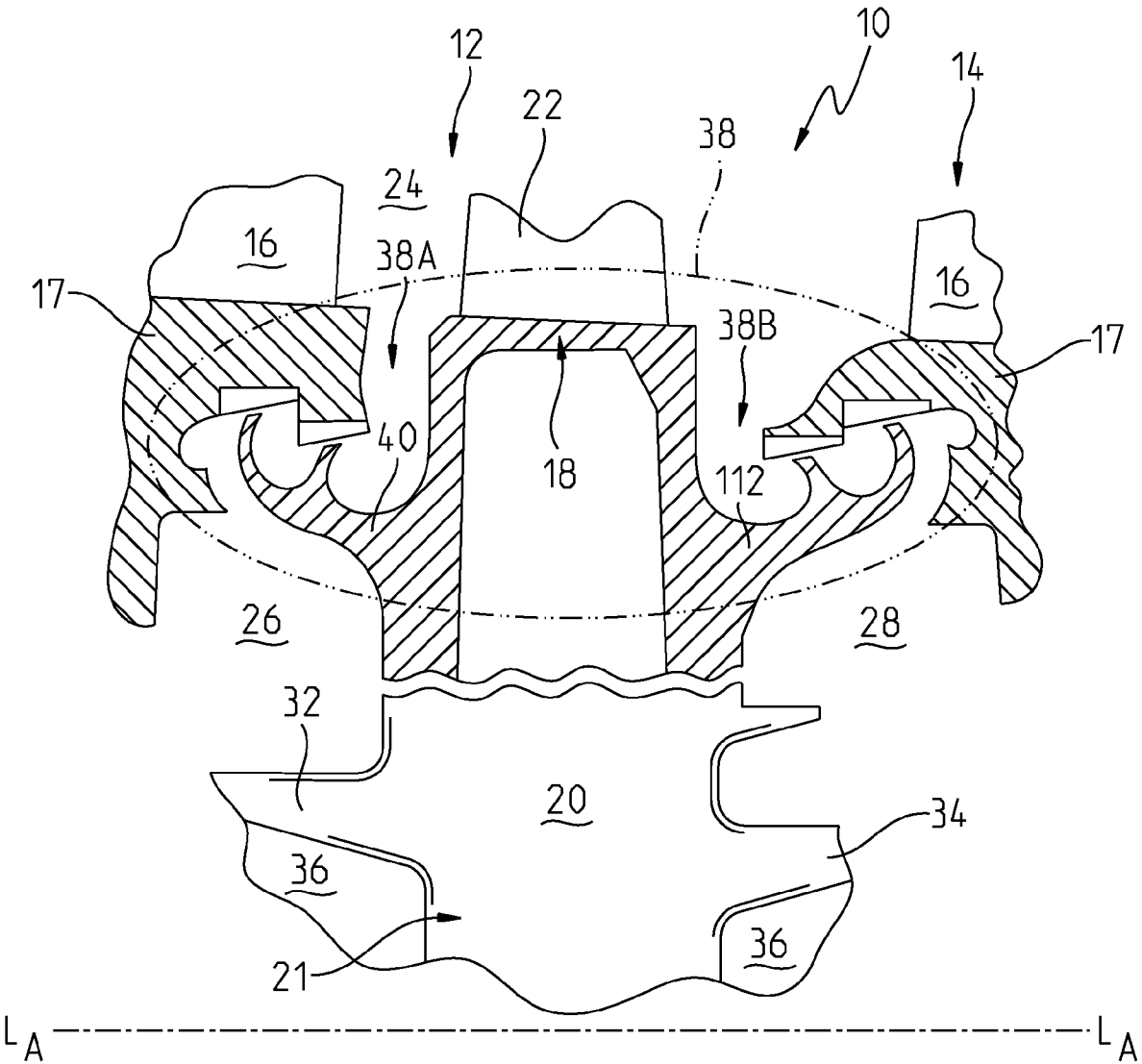
FIG. 1 is a diagrammatic sectional view of a portion of a gas turbine engine including a seal assembly in accordance with the invention.

Referring to FIG. 1, a portion of a turbine engine 10 is illustrated diagrammatically including adjoining stages 12, 14, each stage comprising an array of stationary components, illustrated herein as vanes 16 suspended from an outer casing (not shown) and affixed to an annular inner shroud 17, and a rotating blade structure 18 supported on a disc structure 20 for rotation on a turbine rotor 21. The vanes 16 and the blade structures 18 are positioned circumferentially within the engine 10 with alternating rows of vanes 16 and blade structures 18 located in an axial direction defining a longitudinal axis $L_A$ of the engine 10. The vanes 16 and airfoils 22 of the blade structures 18 extend into an annular hot gas path 24. A working gas comprising hot combustion gases is directed through the hot gas path 24 and flows past the vanes 16 and the airfoils 22 to remaining stages during operation of the engine 10. Passage of the working gas through the hot gas path 24 causes rotation of the blade structures 18 and corresponding disc structures 20 to provide rotation of the turbine rotor 21. As used herein, the term "blade structure" may refer to any structure associated with the corresponding disc structure 20 that rotates with the disc structure 20 and the turbine rotor 21, e.g., airfoils 22, roots, side plates, platforms, shanks, etc.

First disc cavities 26 and second disc cavities 28 are illustrated located radially inwardly from the hot gas path 24. Purge air is provided from a cooling fluid, e.g., air, passing through internal passages (not shown) in the vanes 16 and inner shrouds 17 to the disc cavities 26, 28 to cool the blade structures 18. The purge air also provides a pressure balance against the pressure of the working gas flowing in the hot gas path 24 to counteract a flow of the working gas into the disc cavities 26, 28. Annular cooling cavities 36 are formed between the opposed portions of adjoining disc structures 20 on inner sides of paired annular platform arms 32, 34. The annular cooling cavities 36 receive cooling air passing through cooling air passages (not shown) to cool the disc structures 20. Cooling air from the annular cooling cavities 36 may be provided into the disc cavities 26, 28 in addition to or instead of from the internal passages in the vanes 16 and inner shrouds 17.

Structure on the blade structures 18 and the inner shrouds 17 radially inwardly from the airfoils 22 and the vanes 16 cooperate to form an annular disc rim seal assembly 38 between the hot gas path 24 and the disc cavities 26, 28. It is noted that only one disc rim seal assembly 38 is shown in FIG. 1, but that in a typical engine 10, additional disc rim seal assemblies 38 may be used between the hot gas path 24 and additional disc cavities 26, 28 associated with other stages. Generally, the seal assembly 38 comprises first and second annular seal apparatuses 38A, 38B. The first seal apparatus 38A creates a seal to substantially limit or minimize leakage of the working gas from the hot gas path 24 into the first disc cavity 26. The second seal apparatus 38B creates a seal to substantially limit or minimize leakage of the working gas from the hot gas path 24 into the second disc cavity 28. It is understood that other first and second seal apparatuses 38A, 38B formed between the hot gas path 24 and other disc cavities 26, 28 within the engine 10 are substantially similar to the first and second seal apparatuses 38A and 38B described herein.

Figure 2:
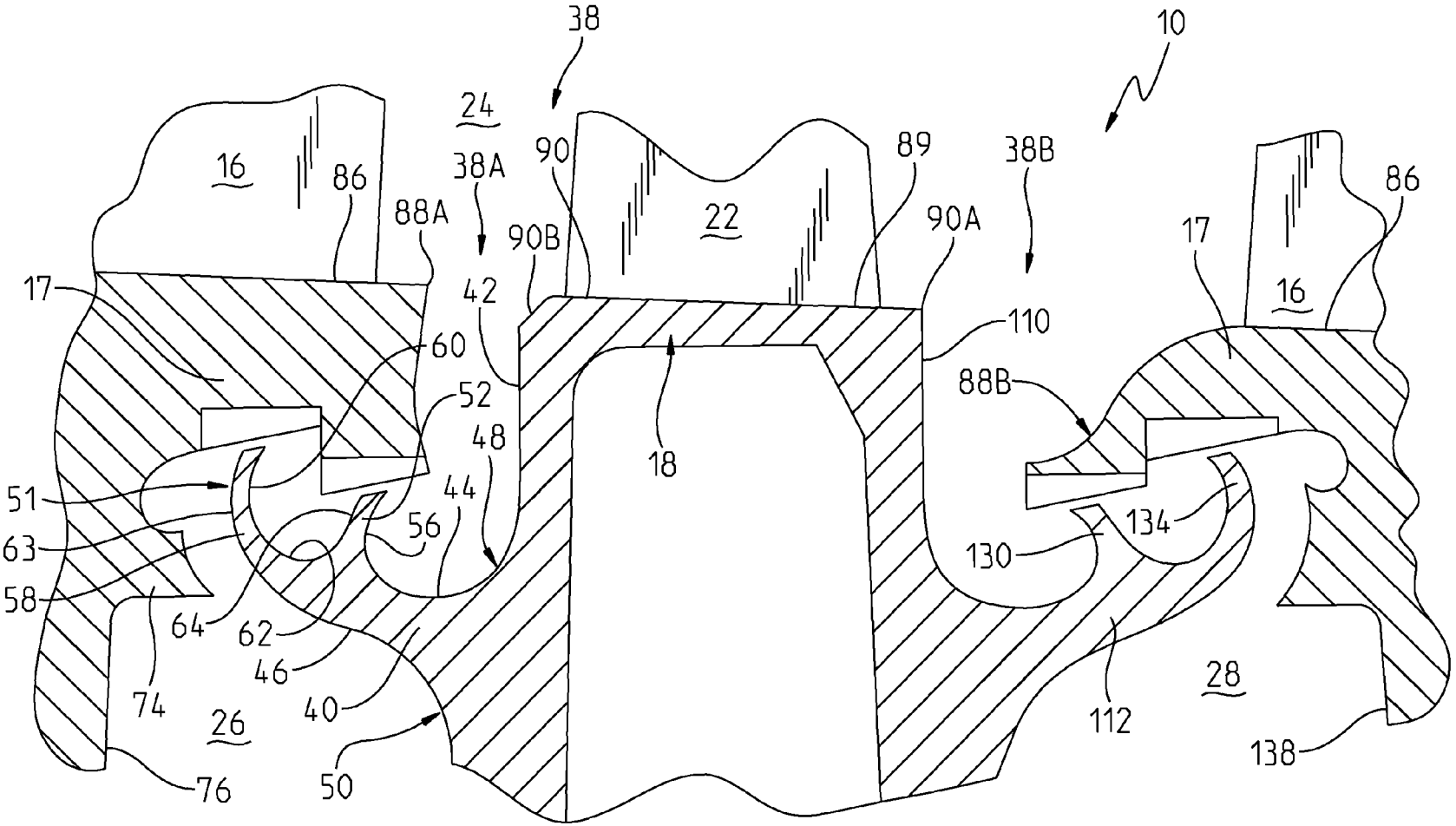
FIG. 2 is an enlarged sectional view of the seal assembly illustrated in FIG. 1.
Figure 3:
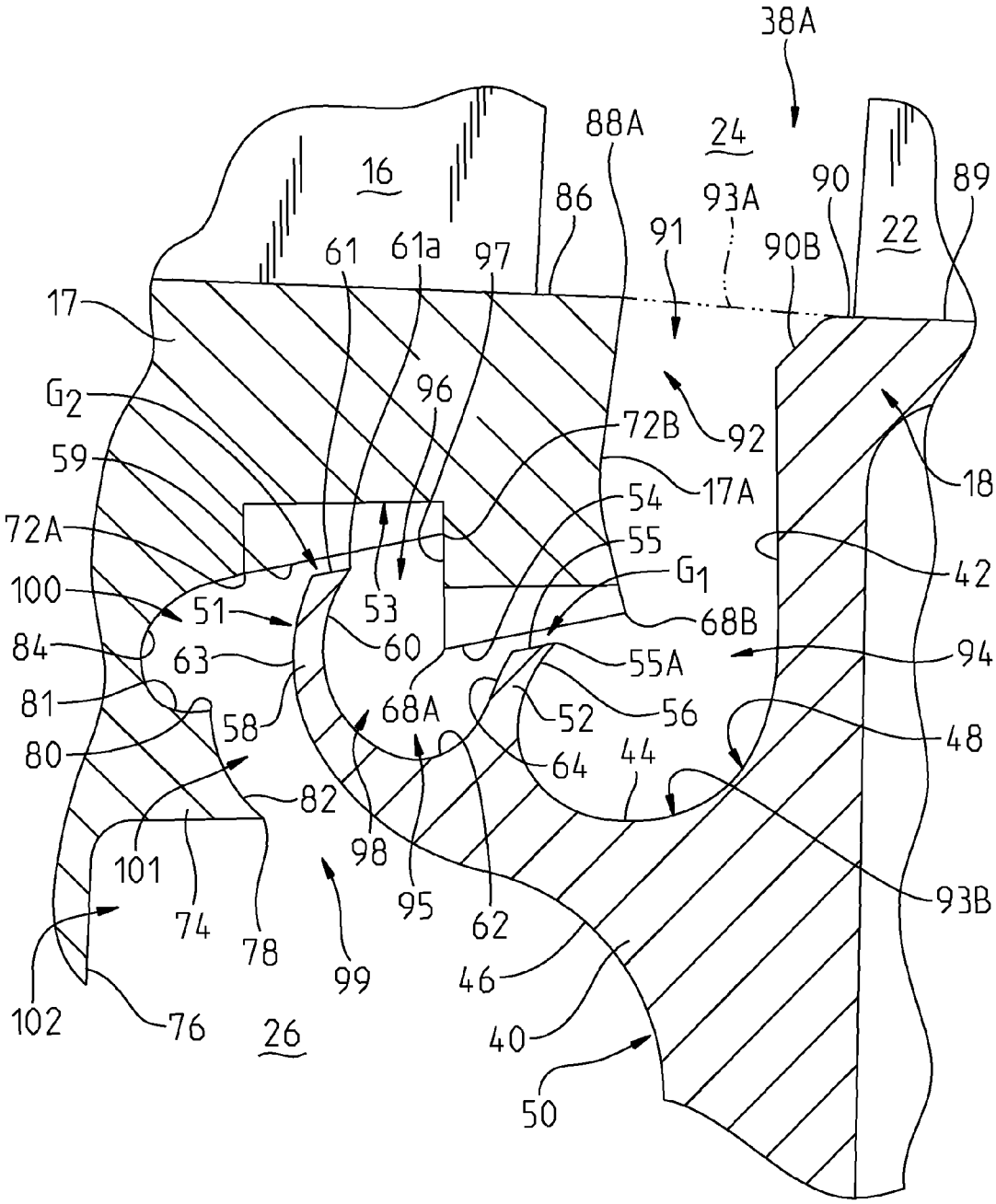
FIG. 3 is an enlarged sectional view of a first seal apparatus of the seal assembly illustrated in FIGS. 1 and 2.

Referring additionally to FIGS. 2 and 3, the first seal apparatus 38A is shown. The first seal apparatus 38A is associated with a first axially facing side 42 of the blade structure 18, illustrated in FIGS. 2 and 3 as an upstream side of the blade structure 18, and associated with the first disc cavity 26.

A first wing member 40 extends axially from the first axially facing side 42 of the blade structure 18 toward the upstream annular inner shroud 17. The upstream annular inner shroud 17 is associated with the stage 12 and is axially upstream from the blade structure 18. In the embodiment shown, the first wing member 40 is formed from a high temperature alloy, such as, for example, an INCONEL alloy (INCONEL is a registered trademark of Special Metals Corporation), although the first wing member 40 may be formed from any suitable material. In the embodiment shown, the first wing member 40 is integral with the blade structure 18, although it is understood that the first wing member 40 may be separately formed from the blade structure 18 and attached thereto. The first wing member 40 may be generally arcuate shaped in a circumferential direction to substantially correspond to the arcuate shape of the blade structure 18 when viewed axially.

Referring to FIGS. 2 and 3, the first wing member 40 includes a radially outer side 44 facing radially outwardly from the first wing member 40 and a radially inner side 46 facing radially inwardly from the first wing member 40.

As illustrated in FIGS. 2 and 3, a radially outer base portion 48 of the radially outer side 44 of the first wing member 40 is curved such that a concave surface of the radially outer base portion 48 faces radially outwardly. A radially inner base portion 50 of the radially inner side 46 of the first wing member 40 is curved such that a concave surface of the radially inner base portion 50 faces radially inwardly. An end potion 51 of the radially inner side 46 of the first wing member 40 is curved such that a convex surface of the end portion 51 defined along the radially inner side 46 faces the upstream annular inner shroud 17, as shown in FIGS. 2 and 3. Additional details in connection with the curved end portion 51 of the first wing member 40 will be discussed below.

A first wing flange 52 extends from the radially outer side 44 of the first wing member 40, as shown in FIGS. 2 and 3. The first wing flange 52 may be formed from a high temperature alloy, such as, for example, an INCONEL alloy, although the first wing flange 52 may be formed from any suitable material. The first wing flange 52 may be integral with the first wing member 40 as illustrated in FIGS. 2 and 3, or may be separately formed and affixed to the first wing member 40 using any suitable affixation procedure, such as, for example, by welding. It is noted that the portion of the radially outer side 44 of the first wing member 40 that spans between the first axially facing side 42 of the blade structure 18 and the first wing flange 52 defines a smooth, curved transition from the first axially facing side 42 of the blade structure 18 to the first wing flange 52, as shown in FIGS. 2 and 3.

Referring to FIG. 3, the first wing flange 52 extends toward a first radially inwardly facing surface 54 of a radially inwardly facing side 53 of the upstream annular inner shroud 17. The first radially inwardly facing surface 54 of the upstream annular inner shroud 17 axially overlaps the first wing flange 52, such that a radial first gap $G_1$ is formed between the first radially inwardly facing surface 54 of the upstream annular inner shroud 17 and a radially outer edge surface 55 of the first wing flange 52, see FIG. 3. The radial first gap $G_1$, which is slightly oversized in FIGS. 1, 2, 3, and 3A for clarity, includes a dimension in the radial direction of, for example, about 2-5 millimeters, although it is noted that the radial dimension of the radial first gap $G_1$ may vary depending on the particular configuration of the engine 10.

Referring to FIGS. 2 and 3, the first wing flange 52 is curved such that a concave first surface 56 of the first wing flange 52 faces the first axially facing side 42 of the blade structure 18. A radially outer portion of the first wing flange 52 adjacent to the radially outer edge surface 55 includes a component that is angled toward the first axially facing side 42 of the blade structure 18.

As shown in FIGS. 2 and 3, the end portion 51 of the first wing member 40 comprises a second wing flange 58. It is noted that the second wing flange 58 may be an extension of the first wing member 40, as shown in FIGS. 2 and 3, or the second wing flange 58 may be separately formed and attached to the first wing member 40 using any suitable affixation procedure, such as, for example, by welding.

As shown in FIG. 3, the second wing flange 58 extends toward a second radially inwardly facing surface 59 of the radially inwardly facing side 53 of the upstream annular inner shroud 17. The second radially inwardly facing surface 59 is radially outward from the first radially inwardly facing surface 54 of the radially inwardly facing side 53. The second radially inwardly facing surface 59 of the upstream annular inner shroud 17 axially overlaps the second wing flange 58, such that a radial second gap $G_2$ is formed between the second radially inwardly facing surface 59 of the upstream annular inner shroud 17 and a radially outer edge surface 61 of the second wing flange 58, see FIG. 3. The radial second gap $G_2$, which is slightly oversized as shown in FIGS. 1, 2, 3 and 3A for clarity, includes a dimension in the radial direction of, for example, about 2-5 millimeters, although it is noted that the radial dimension of the radial second gap $G_2$ may vary depending on the particular configuration of the engine 10.

Referring to FIGS. 2 and 3, the second wing flange 58 is curved such that a concave first surface 60 of the second wing flange 58 faces the first axially facing side 42 of the blade structure 18. A second surface 63 of the second wing flange 58 is opposed from the concave first surface 60 thereof. It is noted that the curved radially inner side 46 of the first wing member 40 may be defined herein as comprising the second surface 63 of the second wing flange 58. That is, the curved radially inner side 46 of the first wing member 40 may span from the radially inner base portion 50 of the first wing member 40 to the radially outer edge surface 61 of the second wing flange 58. A radially outer portion of the second wing flange 58 adjacent to the radially outer edge surface 61 includes a component that is angled toward the first axially facing side 42 of the blade structure 18.

As shown in FIGS. 2 and 3, an intermediate portion 62 of the radially outer side 44 of the first wing member 40 comprises a portion of the radially outer side 44 of the first wing member 40 between the first and second wing flanges 52, 58, i.e., between a second surface 64 of the first wing flange 52 and the concave first surface 60 of the second wing flange 58. The intermediate portion 62 is curved such that a concave surface of the intermediate portion 62 faces radially outwardly. It is noted that the intermediate portion 62 defines a smooth, curved transition from the first wing flange 52 to the second wing flange 58.

At least a portion of the first radially inwardly facing surface 54 of the upstream annular inner shroud 17 may comprise an abradable material, such as, for example, a honeycomb material, so as to prevent or reduce abrasion and wear of the first wing flange 52 in the event that rubbing contact occurs between the first radially inwardly facing surface 54 and the first wing flange 52. Further, at least a portion of the second radially inwardly facing surface 59 of the upstream annular inner shroud 17 may comprise an abradable material, such as, for example, a honeycomb material, so as to prevent or reduce abrasion and wear of the second wing flange 58 in the event that rubbing contact occurs between the second radially inwardly facing surface 59 and the second wing flange 58. The use of the abradable material permits the use of minimum clearances between the first and second wing flanges 52, 58 and the respective first and second radially inwardly facing surfaces 54, 59, i.e., the radial dimensions of the radial first and second gaps $G_1$, $G_2$.

In the embodiment shown in FIG. 3, the first radially inwardly facing surface 54 of the upstream annular inner shroud 17 is angled from an axially forward edge 68A to an axially aft edge 68B thereof in the radial direction. Also, the second radially inwardly facing surface 59 of the upstream annular inner shroud 17 is angled from an axially forward edge 72A to an axially aft edge 72B thereof in the radial direction. Thus, in the case of axial movement of the rotating components, e.g., the turbine rotor 21, the disc structure 18, the blade structure 20, and the first wing member 40, with respect to the stationary components, e.g., the annular inner shrouds 17 and their associated vanes 16, the radial dimensions of the radial first and second gaps $G_1$, $G_2$ may be reduced. Such axial movement may result, for example, during a designed hydraulic upstream movement of the turbine rotor 21 and the structure coupled thereto.

An axial shroud flange 74, illustrated in FIGS. 2 and 3, extends axially from an axially facing side 76 of the upstream annular inner shroud 17 toward the first wing member 40. As shown in FIG. 3, the axial shroud flange 74 comprises a radially inner edge 78, a radially outer edge 80, and a curved side 82 that spans between the inner and outer edges 78, 80. The curved side 82 comprises a concave surface that faces the curved radially inner side 46 of the first wing member 40.

As shown in FIG. 3, the axially facing side 76 of the upstream annular inner shroud 74 comprises a curved transition side 84 that extends from the second radially inwardly facing surface 59 of the upstream annular inner shroud 17 to a radially outer side 81 of the axial shroud flange 74 adjacent to the radially outer edge 80 thereof. The radially outer side 81 of the axial shroud flange 74 is curved and contiguous with the curved surface of the curved transition side 84 of the upstream annular inner shroud 17. The curved transition side 84 has a concave surface that faces the curved radially inner side 46 of the first wing member 40. Additional details in connection with the axial shroud flange 74 will be discussed below.

As shown in FIGS. 2 and 3, a radially outwardly facing side 86 of the upstream annular inner shroud 17 faces the hot gas path 24. The radially outwardly facing side 86 of the upstream annular inner shroud 17 extends radially outwardly further than an outwardly facing surface 89 of a platform 90 of the downstream blade structure 18. Additionally, the outwardly facing surface 89 of the blade structure platform 90 extends radially outwardly further than the radially outwardly facing side 86 of the downstream annular inner shroud 17. Thus, the radially outwardly facing sides 86 of the annular inner shrouds 17 and the platforms 90 of the blade structures 18 within the engine 10 define a stepped transition for the working gas in the hot gas path 24 and thus assist in maintaining a substantially axial downstream flow of the working gas in the hot gas path 24. It is noted that a generally sharp downstream or aft edge 88A of the radially outwardly facing side 86 of the upstream annular inner shroud 17 and a generally sharp aft edge 90A (see FIG. 2) of the blade structure platform 90 also assist in maintaining a substantially axial flow of the working gas in the hot gas path 24.

As shown in FIGS. 2 and 3, a forward edge portion 90B of the blade structure platform 90 includes an inclination angle in the direction of flow through the hot gas path 24. A portion $P_{O1}$ of the working gas (see FIG. 3A) that contacts the forward edge portion 90B of each platform 90 is directed radially outwardly and back into the hot gas path 24, as will be discussed below.

Figure 3A:
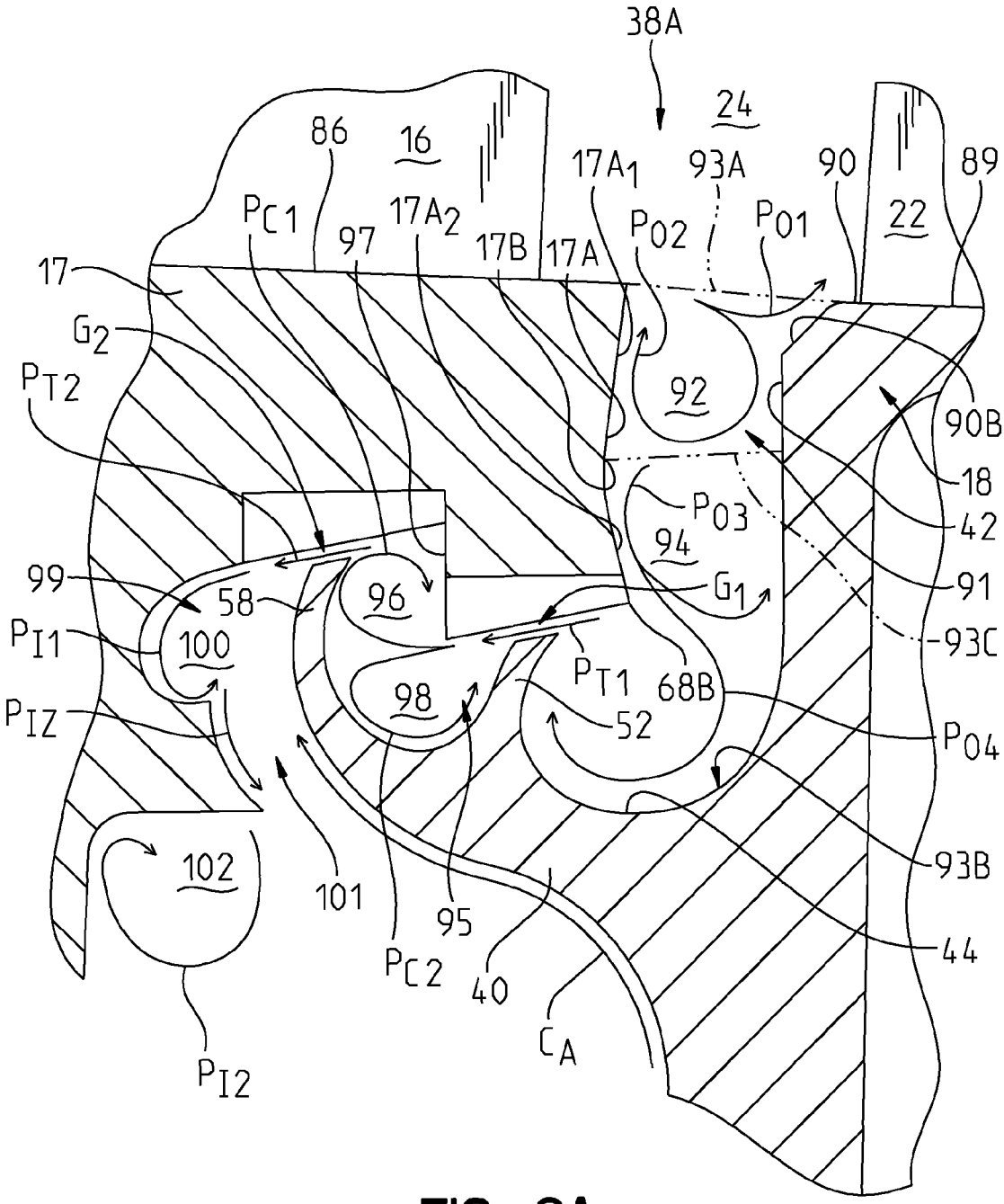
FIG. 3A is an enlarged sectional view illustrating a plurality of regions and recirculation zones defined by the first seal apparatus illustrated in FIG. 3.

Referring to FIG. 3A, the first seal apparatus 38A defines a plurality of regions, each region including one or more recirculation zones that effect a recirculation of portions of working gas that have entered each of the respective recirculation zones back toward an upstream region and ultimately back toward the hot gas path 24.

An outer region 91 is defined radially inwardly from the hot gas path 24 between an outer boundary 93A and an inner boundary 93B. The outer boundary 93A is defined by a steam line extending from the radially outwardly facing side 86 of the upstream annular inner shroud 17 to the outwardly facing surface 89 of the blade structure platform 90. The inner boundary 93B is defined by the radially outer side 44 of the first wing member 40. The outer region 91 is further defined between the first axially facing side 42 of the blade structure 18, the upstream annular inner shroud 17, and the concave first surface 56 of the first wing flange 52. The outer region 91 includes a first outer recirculation zone 92 and a second outer recirculation zone 94.

The first outer recirculation zone 92 is defined radially inwardly from the hot gas path 24 and the outer boundary 93A. Further, the first outer recirculation zone 92 is axially located between the first axially facing side 42 of the blade structure 18, the forward edge portion 90B of the blade structure platform 90, and an axial end portion 17A of the upstream annular inner shroud 17 having a radial component, see FIGS. 3 and 3A. Once working gas enters the first outer recirculation zone 92 from the hot gas path 24, it is initially directed into two recirculating portions comprising the first outer portion $P_{O1}$ and a second outer portion $P_{O2}$. The first outer portion $P_{O1}$ comprises a portion of the working gas that contacts the forward edge portion 90B of the blade structure platform 90 and is deflected in a first direction of rotation, i.e., counterclockwise as shown in FIG. 3A, radially outwardly and back into the hot gas path 24, see FIG. 3A. The second outer region portion $P_{O2}$ comprises a portion of the working gas that flows in a second direction of rotation opposite to the first direction of rotation, i.e., clockwise as shown in FIG. 3A, into a reduced pressure area formed behind the upstream annular shroud 17 and contacts the first axially facing side 42 of the blade structure 18. In particular, as the working gas in the hot gas path 24 flows past the aft edge 88A of the radially outwardly facing side 86 of the upstream annular inner shroud 17, the working gas separates from the outwardly facing side 86 and forms a low pressure region in the first outer recirculation zone 92 that draws in the portion of the working gas that forms the second outer region portion $P_{O2}$.

The second outer region portion $P_{O2}$ of the working gas diverges inwardly from the first outer region portion $P_{O1}$, and is deflected radially inwardly upon contacting the forward edge portion 90B and the first axially facing side 42 of the blade structure 18. Further, as the portion of the working gas forming the second outer region portion $P_{O2}$ is drawn into the lower pressure region of the first outer recirculation zone 92 and is deflected back toward the upstream annular inner shroud 17 at the first axially facing side 42 of the blade structure 18, it recirculates toward the upstream annular inner shroud 17 where it stagnates against the axial end portion 17A and is directed radially outwardly back toward the hot gas path 24.

A third outer region portion $P_{O3}$ of the working gas comprises a portion of the second outer region portion $P_{O2}$ that diverges inwardly from the main flow of the second outer region portion $P_{O2}$ and flows radially inwardly from the first outer recirculation zone 92 and into the second outer recirculation zone 94. That is, the third outer region $P_{O3}$ of the working gas generally comprises a portion of the second outer region $P_{O2}$ that is directed radially inwardly as it contacts or approaches the axial end portion 17A of the upstream annular inner shroud 17. The second outer recirculation zone 94 is defined radially inwardly from the first outer recirculation zone 92 and extends to the inner boundary 93B, i.e., the radially outer side 44 of the first wing member 40. Further, the second outer recirculation zone 94 is located axially between the first axially facing side 42 of the blade structure 18 and the concave first surface 56 of the first wing flange 52. It is noted that the first and second outer recirculation zones 92, 94 are divided at an intermediate boundary 93C defined by the axial end portion 17A of the upstream annular inner shroud 17. In the illustrated embodiment, the location of the intermediate boundary 93C is defined by an inflexion point 17B between axially upstream angled portions $17A_1$, $17A_2$ of the axial end portion 17A, see FIG. 3A.

The third outer region portion $P_{O3}$ flows in the first direction of rotation radially inwardly past a radially inner edge of the axial end portion 17A and back toward the first axially facing side 42 of the blade structure 18. As the third outer region portion $P_{O3}$ approaches the first axially facing side 42, it recirculates outwardly toward the first recirculation zone 92.

A fourth outer region portion $P_{O4}$ of the working gas comprises a portion of the third outer region portion $P_{O3}$ that flows in the second direction of rotation radially inwardly past the axially aft edge 68B of the upstream annular inner shroud 17 and into a reduced pressure area located between the first radially inwardly facing surface 54 and the radially outer side 44 of the first wing member 40. In particular, as the third outer region portion $P_{O3}$ flows past the axially aft edge 68B, it separates from the axial end portion 17A and forms a low pressure region inwardly from the first radially inwardly facing surface 54 and adjacent to the concave first surface 56 of the first wing flange 52, such that the portion of the working gas forming the fourth outer region portion $P_{O4}$ diverges from the third outer region portion $P_{O3}$. The fourth outer region portion $P_{O4}$ flows toward the radially outer base portion 48 and recirculates in the second direction of rotation radially outwardly along the concave first surface 56 of the first wing flange 52. The fourth outer region portion $P_{O4}$ is further directed away from the radial first gap $G_1$ and back toward the hot gas path 24, i.e., in an axially downstream direction, by the end of concave first surface 56 of the first wing flange 52 angled in the direction of the blade structure first axially facing side 42, as shown in FIG. 3A. It is noted that an upstream edge 55*a* (see FIG. 3) of the radially outer edge surface 55 of the first wing flange 52 comprises a sharp angle, i.e., about 90° or less between adjacent surfaces forming the edge 55*a*, and provides a distinct upstream facing edge 55*a* for resisting hot gas flow moving upstream toward the radial first gap $G_1$. In addition to resisting flow through the first gap $G_1$, the sharp edge 55*a* facilitates maintaining a distinct pressure boundary between opposite sides of the first wing flange 52.

A first transition portion $P_{T1}$ of the working gas, which may comprise a portion of the third and fourth outer region portions $P_{O3}$, $P_{O4}$, will flow through the radial first gap $G_1$ formed between the first radially inwardly facing surface 54 of the upstream annular inner shroud 17 and the first wing flange 52, as shown in FIG. 3A. The first transition portion $P_{T1}$ flows through the radial first gap $G_1$ and into a central region 95 adjacent the outer region 91. As may be further seen in FIG. 3, the central region 95 is bounded by structure defined by the first wing member 40, the radially inwardly facing side 53, i.e., the first and second radially inwardly facing surfaces 54, 59 thereof, and the first and second wing flanges 52, 58, i.e., the second surface 64 of the first wing flange 52 and the concave first surface 60 of the second wing flange 58. The central region 95 includes a first central recirculation zone 96 and a second central recirculation zone 98.

As shown in FIG. 3A, a first central region portion $P_{C1}$ of the working gas, which is a portion of the first transition portion $P_{T1}$, enters the first central recirculation zone 96. The first central recirculation zone 96 is defined radially outwardly from the radial first gap $G_1$ between the first and second radially inwardly facing surfaces 54, 59 of the upstream annular inner shroud 17 and the concave first surface 60 of the second wing flange 58 (FIG. 3). The first central region portion $P_{C1}$ of the working gas is deflected in the second direction of rotation radially outwardly and back toward the radial first gap $G_1$ by the concave first surface 60 of the second wing flange 58, as shown in FIG. 3A.

A second central region portion $P_{C2}$ of the working gas, which is a portion of the first transition portion $P_{T1}$, enters the second central recirculation zone 98. The second central recirculation zone 98 is located radially inwardly from the radial first gap $G_1$ and the first central recirculation zone 96 and extends to the intermediate portion 62 of the radially outer side 44 of the first wing member 40. Further, the second central recirculation zone 98 is located axially between the second surface 64 of the first wing flange 52 and the concave first surface 60 of the second wing flange 58. The second central region portion $P_{C2}$ of the working gas is deflected in the first direction of rotation radially inwardly and back toward the radial first gap $G_1$ by the concave first surface 60 of the second wing flange 58, by the intermediate portion 62 of the radially outer side 44 of the first wing member 40, and by the second surface 64 of the first wing flange 52, as shown in FIG. 3A.

Referring to FIG. 3, it is noted that a radial stepped portion 97 is formed in the radially inwardly facing side 53 of the upstream annular inner shroud 17 between the first and second radially facing surfaces 54, 59. The first and second central region portions $P_{C1}$, $P_{C2}$ of the working gas may be divided at the radial location of the radial stepped portion 97. Specifically, as the first transition portion $P_{T1}$ of the working gas flows into the central region 95, the first central region portion $P_{C1}$ may flow axially from the radial stepped portion 97 toward the concave first surface 60 of the second wing flange 58, and the second central region portion $P_{C2}$ may flow radially inwardly, diverging from the first central region portion $P_{C1}$, see FIG. 3A. In particular, after first transition portion $P_{T1}$ flows through the radial first gap $G_1$, the first transition portion $P_{T1}$ splits into vortex flows proximate to the radial stepped portion 97 comprising the separate first and second central region portions $P_{C1}$, $P_{C2}$, which sweep respectively radially outwardly and inwardly into the concave first surface 60 of the second wing flange 58.

It is noted that the recirculation of the first and second central region portions $P_{C1}$, $P_{C2}$ causes a loss in total pressure of the working gas within the central region 95. The decreased total pressure in the central region 95 results in a reduced pressure differential between the central region 95 and the first disc cavity 26, thus decreasing a tendency of the working gas in the central region 95 to flow toward the first disc cavity 26. It is noted that an upstream edge 61*a* of the radially outer edge surface 61 of the second wing flange 58 comprises a sharp angle, i.e., about 90° or less between adjacent surfaces forming the edge 61*a*, and provides a distinct upstream facing edge 61*a* for resisting hot gas flow moving upstream toward the radial second gap $G_2$. In addition to resisting flow through the radial second gap $G_2$, the sharp edge 61*a* facilitates maintaining a distinct pressure boundary between opposite sides of the second wing flange 58.

Referring to FIG. 3A, a second transition portion $P_{T2}$ of the working gas, which is a portion of the first transition portion $P_{T1}$, will flow from the central region 95 through the radial second gap $G_2$ formed between the second radially inwardly facing surface 59 of the upstream annular inner shroud 17 and the second wing flange 58. The second transition portion $P_{T2}$ flows through the radial second gap $G_2$ and into an inner region 99 adjacent the central region 95 on an opposed side of the central region 95 from the outer region 91. As may be further seen in FIG. 3, the inner region 99 is bounded by structure defined by the second radially inwardly facing surface 59 of the upstream annular inner shroud 17 and extending radially to a location radially inwardly from the radially inner edge 78 of the axial shroud flange 74. In addition, the inner region 99 is defined between the second surface 63 of the second wing flange 58, i.e., the curved radially inner side 46 of the first wing member 40, and the axially facing side 76 of the upstream annular inner shroud 17, including the area of the curved transition side 84 and extending to a location radially inwardly from the axial shroud flange 74.

The inner region 99 includes a first inner recirculation zone 100 and a second inner recirculation zone 102, and a throat region 101 connecting the first and second inner recirculation zones 100, 102. The first inner recirculation zone 100 comprises a portion of the inner region 99 generally located radially outwardly from the radially outer edge 80 of the axial shroud flange 74. The second inner recirculation zone 102 comprises a portion of the inner region 99 defined by a pocket generally located radially inwardly from the radially inner edge 78 of the axial shroud flange 74 and located adjacent to the axially facing side 76 of the upstream annular inner shroud 17. The throat region 101 comprises a portion of the inner region 99 that extends radially between the radially inner and outer edges 78, 80 of the axial shroud flange 74, and located between the curved side 82 of the axial shroud flange 74 and the curved radially inner side 46 of the first wing member 40.

A first inner region portion $P_{I1}$ of the working gas, which is a portion of the second transition portion $P_{T2}$, enters the first inner recirculation zone 100. The first inner region portion $P_{I1}$ of the working gas flows axially toward the axially facing side 76 of the upstream annular inner shroud 17 and is deflected in the first direction of rotation back toward the curved radially inner side 46 of the first wing member 40 by the curved transition side 84 of the axially facing side 76 of the upstream annular inner shroud 17 and by the radially outer side 81 of the axial shroud flange 74, as shown in FIG. 3A. As the first inner region portion $P_{I1}$ flows axially from the axial shroud flange 74 toward the first wing member 40, it is directed into a flow of cooling air $C_A$ that flows radially outwardly along the radially inner side 46 of the first wing member 40, as shown in FIG. 3A. The flow of cooling air $C_A$ may be provided, for example, from a corresponding annular cooling cavity 36 (see FIG. 1). The flow of cooling air $C_A$ pushes the first inner region portion $P_{I1}$ of the working gas back toward the radial second gap $G_2$. As the flow of cooling air $C_A$ continues up the radially inner side 46 to the sharply curved outer end of the first wing member 40, it may separate and form a turbulent region in the first inner recirculation zone 100, adjacent to the radially outer edge surface 61, which mixes with the second transition portion $P_{T2}$ to further restrict the flow of working gas through the radial second gap $G_2$.

A radial inner zone portion $P_{IZ}$ of the working gas comprises a portion of the second transition portion $P_{T2}$ that may flow radially inwardly from the first inner recirculation zone 100 through the throat region 101 formed between the curved side 82 of the axial shroud flange 74 and the curved radially inner side 46 of the first wing member 40. As the radial inner zone portion $P_{IZ}$ of the working gas flows past the radially inner edge 78 of the axial shroud flange 74, the flow separates from the axial shroud flange 74 and forms a low pressure area defining the second inner recirculation zone 102. The flow of the radial inner zone portion $P_{IZ}$ is directed away from the radially inner surface 46 of the first wing member and moves into the second inner recirculation zone 102 to form a vortex flow in the second direction of rotation comprising a second inner region portion $P_{I2}$. The formation of the second inner region portion $P_{I2}$ operates to limit the radial inward movement of the radial inner zone portion $P_{IZ}$ of the working gas toward the interior of the first disc cavity 26.

It is noted that the flow of cooling air $C_A$ may also assist in pushing other portions, e.g., portions $P_{O2}$, $P_{O4}$, $P_{C1}$, $P_{C2}$, $P_{I1}$, and $P_{IZ}$ of the working gas, back toward the hot gas path 24, as some of the cooling air $C_A$ may ultimately end up mixing with one or more of these portions $P_{O2}$, $P_{O4}$, $P_{C1}$, $P_{C2}$, $P_{I1}$, and $P_{IZ}$ of the working gas and flowing all the way through the first seal apparatus 38A and into the hot gas path 24.

It is noted that the radial placement of the first and second wing flanges 52 and 58, in combination with the location of the first and second radially inwardly facing surfaces 54, 59 of the upstream annular inner shroud 17, provides an increase in the total pressure loss of the working gas, and thus decreases a tendency of the working gas to flow to the first disc cavity 26. Additionally, the rotation of the blade structure 18 and the first wing member 40 along with the turbine rotor 21 and disc structure 20 creates a pumping action that additionally resists the flow of the working gas from the hot gas path 24 into the first disc cavity 26. Hence, the successive pressure reductions provided by the recirculation zones of the outer, central and inner regions 91, 95 and 99 operate to minimize or reduce hot gas ingestion to the first disc cavity 26.

It is also noted that, although two wing flanges are shown in this embodiment, i.e., the first and second wing flanges 52, 58, additional or fewer wing flanges may be employed in a given engine 10 according to other embodiments of the invention.

Figure 4:
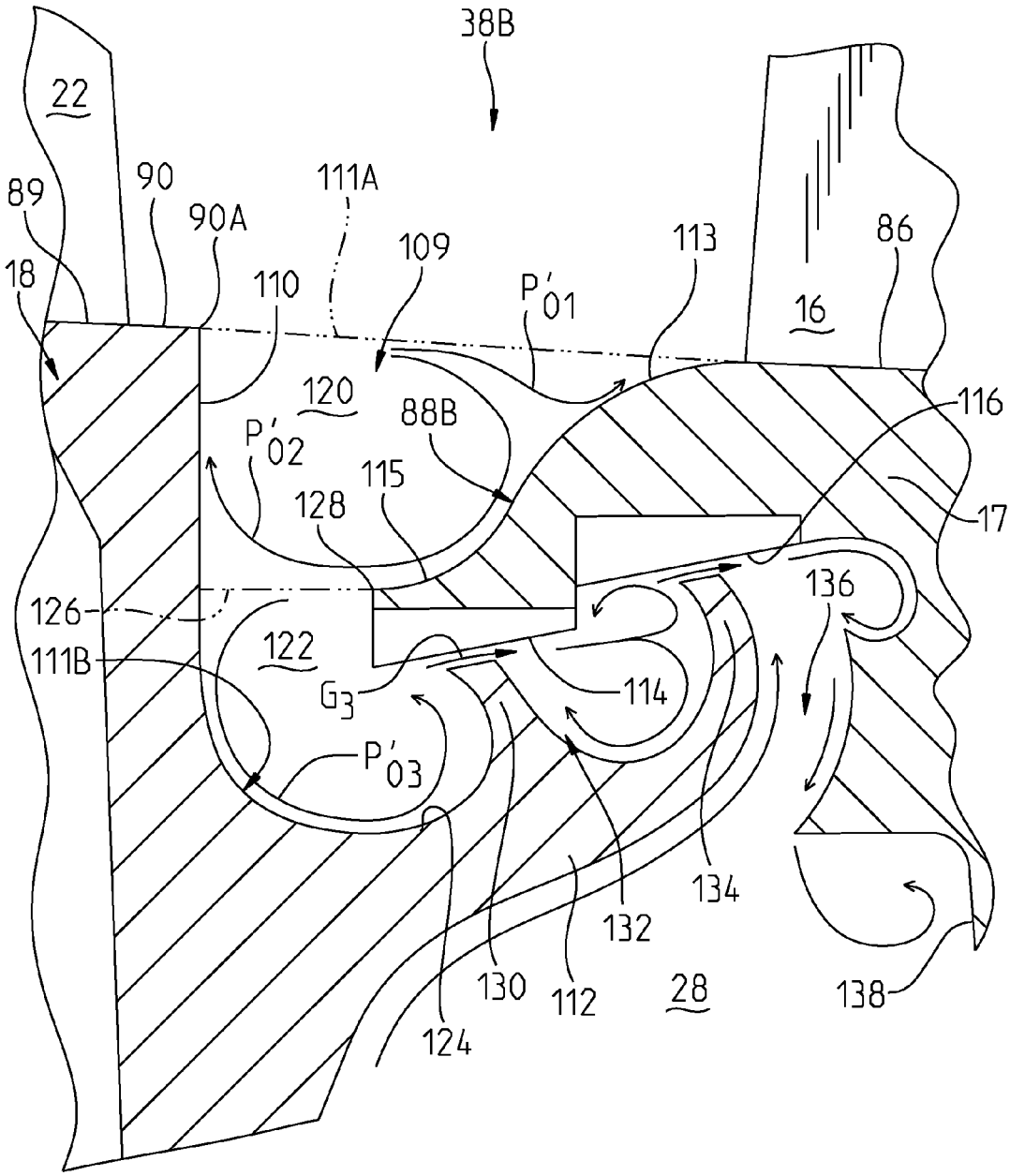
FIG. 4 is an enlarged sectional view of a second seal apparatus of the seal assembly illustrated in FIGS. 1 and 2.

Referring to FIG. 4, the second seal apparatus 38B is shown. The second seal apparatus 38B is associated with a second axially facing side 110 of the blade structure 18 and the downstream annular inner shroud 17 and its corresponding vanes 16. The downstream annular inner shroud 17 is associated with the stage 14 shown in FIG. 1 and is axially downstream from the blade structure 18 illustrated in FIG. 4. The second seal apparatus 38B functions to substantially limit or minimize working gas from the hot gas path 24 from flowing into the second disc cavity 28 in a manner similar to the first seal apparatus 38A described above for minimizing flow of working gas toward the first disc cavity 26. With regard to the second seal apparatus 38B, only those portions of the seal apparatus 38B that differ in structure or operation from the first seal apparatus 38A are described in detail. Further, portions ("P") of the hot working gas corresponding to similar hot working gas portions described with reference to the first seal apparatus 38A are labeled with the same reference primed ("P").

In this embodiment, an outer region 109 is defined radially inwardly from the hot gas path 24 between an outer boundary 111A and an inner boundary 111B. The outer boundary 111A is defined by a steam line extending from the radially outwardly facing surface 89 of the blade structure 18 to the outwardly facing side 86 of the downstream annular inner shroud 17. The inner boundary 111B is defined by a radially outer side 124 of a second wing member 112 extending from the second axially facing side 110 of the blade structure 18.

A forward end portion 88B of the downstream annular inner shroud 17 is curved to define a substantially S-shaped cross-section such that it faces radially outwardly, i.e., toward the hot gas path 24. The S-shaped forward end portion 88B includes an outer convex surface 113 that forms an inclination in the direction of flow through the hot gas path 24, and an inner concave surface 115 extending toward the second axially facing side 110 of the blade structure 18. Thus, when working gas flowing substantially axially in the hot gas path 24 contacts the outer convex surface 113 of the forward end portion 88B, a first outer portion $P'_{O1}$ (see FIG. 4) of the working gas is deflected in the first direction of rotation radially outwardly and back into the hot gas path 24.

A second outer region portion $P'_{O2}$ comprises a portion of the working gas that flows into a reduced pressure area formed in a first outer recirculation zone 120 behind the second axially facing side 110 of the blade structure 18 and contacts the inner concave surface 115 of the S-shaped forward end portion 88B. In particular, as the working gas in the hot gas path 24 flows past the downstream edge 90A of the blade structure platform 90, the working gas separates from the outwardly facing side 89 and forms a low pressure region in the first outer recirculation zone 120 that draws in the portion of the working gas that forms the second outer region portion $P_{O2}$.

The second outer region portion $P_{O2}$ of the working gas diverges inwardly from first outer region portion $P_{O1}$, and is deflected radially inwardly upon contacting the inner concave surface 115 of the forward edge portion 88B. Further, as the portion of the working gas forming the second outer region portion $P_{O2}$ is drawn into the lower pressure region of the first outer recirculation zone 120 and is deflected back toward blade structure 18, it recirculates in the second direction of rotation toward the second axially facing side 110 of the blade structure 18 where it stagnates against the second axially facing side 110 and is directed radially outwardly back toward the hot gas path 24.

A third outer region portion $P'_{O3}$ of the working gas, which comprises a portion of the second outer region portion $P'_{O2}$, diverges inwardly from the main flow of the second outer region portion $P'_{O2}$ and flows radially inwardly from the first outer recirculation zone 120 and into a second outer recirculation zone 122. That is, the third outer region portion $P'_{O3}$ of the working gas generally comprises a portion of the second outer region portion $P'_{O2}$ that is directed inwardly as it contacts or approaches the second axially facing side 110 of the blade structure 18. The second outer recirculation zone 122 is defined radially inwardly from the first outer recirculation zone 120 and extends to the inner boundary 111B defined on the radially outer side 124 of the second wing member 112. It is noted that the first and second outer recirculation zones 120, 122 are divided at an intermediate boundary 126 defined at the radial location of an axially forward edge 128 of the S-shaped forward end portion 88B.

The third outer region portion $P_{O3}$ flows toward a first wing flange 130 and recirculates in the first direction of rotation radially outwardly and back toward the second axially facing side 110 of the blade structure 18. The third outer region portion $P_{O3}$ is further directed away from a radial third gap $G_3$ between the first wing flange 130 and a first radially inwardly facing surface 114 of the downstream annular inner shroud 17 and back toward the hot gas path 24, i.e., in an axially upstream direction.

The remaining structure and operation of the second seal apparatus 38B is substantially similar to the structure and operation described above with regard to the first seal apparatus 38A. That is, the second seal apparatus 38B includes a central region 132 defined between the first wing flange 130 and a second wing flange 134, and an inner region 136 formed between an axially facing side 138 of the downstream annular inner shroud 17 and the second wing flange 134. Although not specifically described, the central and inner regions 132 and 136 include vortex flow portions similar to those described for the central and inner regions 95, 99 of the first seal apparatus 38A. The second seal apparatus 38B functions to substantially limit or minimize working gas in the hot gas path 24 from flowing into the second disc cavity 28 in substantially the same manner as described above with reference to the first seal apparatus 38A. Other seal apparatuses 38A, 38B within the engine 10 function to reduce the amount of the working gas that enter respective disc cavities 26, 28 in substantially the same manner as the first and second seal apparatuses 38A, 38B described herein.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A seal assembly that limits gas leakage from a hot gas path to one or more disc cavities in a gas turbine engine comprising a plurality of stages, each stage comprising a plurality of stationary components and a disc structure supporting a blade structure comprising a row of airfoils for rotation on a turbine rotor, the seal assembly comprising:

a seal apparatus that limits gas leakage from the hot gas path to a disc cavity associated with an axially facing side of the blade structure, said seal apparatus comprising:

an annular inner shroud associated with adjacent stationary components, said annular inner shroud comprising a radially inwardly facing side and a radially outwardly facing side;

a wing member extending axially from said axially facing side of the blade structure toward said annular inner shroud, said wing member including a radially inner side and a radially outer side;

a first wing flange extending radially outwardly from said radially outer side of said wing member toward said radially inwardly facing side of said annular inner shroud, said first wing flange being curved in a radial direction and having a concave first surface facing said axially facing side of the blade structure and a second surface opposed from its concave first surface that faces away from said axially facing side of the blade structure, wherein a radially outer edge of said first wing flange is located proximate to said radially inwardly facing side of said annular inner shroud such that a radial first gap having a dimension in the radial direction is formed between said first wing flange and said radially inwardly facing side of said annular inner shroud;

an outer region defined radially inwardly from the hot gas path between said axially facing side of the blade structure, said annular inner shroud, said radially outer side of said wing member, and said concave first surface of said first wing flange;

a central region adjacent said outer region and defined between said wing member and said radially inwardly facing side of said annular inner shroud, and located adjacent to said second surface of said first wing flange; and wherein said concave first surface of said first wing flange limits a passage of working gas in said outer region through said radial first gap into said central region by recirculating at least a portion of said working gas in said outer region away from said radial first gap and back toward the hot gas path.

2. The seal assembly according to claim 1, wherein said outer region is defined between an outer boundary and an inner boundary, said outer boundary defined by a steam line extending from an outer surface of a platform of said blade structure adjacent said airfoils to a portion of said radially outwardly facing side of said annular inner shroud adjacent said stationary components, and said outer region comprises:

a first outer recirculation zone defined radially inwardly from said outer boundary between said axially facing side of the blade structure and a portion of said radially outer side of said annular inner shroud having a radial component; and a second outer recirculation zone defined radially inwardly from said first outer recirculation zone, said second outer recirculation zone defined between said axially facing side of the blade structure, said concave first surface of said first wing flange, and said inner boundary defined by said radially outer side of said wing member.

3. The seal assembly according to claim 2, wherein an axial end portion of said annular inner shroud defines an intermediate boundary that divides said first outer recirculation zone from said second outer recirculation zone.

4. The seal assembly according to claim 3, wherein at least one of said radially outer side of said annular inner shroud and said blade structure platform comprises a curved radially outer side inclined radially in a direction of working gas flow in the hot gas path, said curved radially outer side of said at least one of said radially outer side of said annular inner shroud and said blade structure platform limits a passage of working gas from said first outer region into said second outer region by directing at least a portion of said working gas in said first outer region radially outwardly and back toward the hot gas path.

5. The seal assembly according to claim 1, wherein said radially inwardly facing side of said annular inner shroud comprises a first radially inwardly facing surface including an abradable material.

6. The seal assembly according to claim 1, further comprising a second wing flange axially spaced apart from said first wing flange and extending radially outwardly from said radially outer side of said wing member toward said radially inwardly facing side of said first annular inner shroud, said second wing flange being curved in the radial direction and having a concave first surface facing said axially facing side of the blade structure and a second surface opposed from its concave first surface and facing away from said axially facing side of the blade structure, wherein a radially outer edge of said second wing flange is located proximate to said radially inwardly facing side of said annular inner shroud such that a radial second gap having a dimension in the radial direction is formed between said second wing flange and said radially inwardly facing side of said annular inner shroud.

7. The seal assembly according to claim 6, wherein:

a portion of said first wing flange adjacent to said radially outer edge includes a component that is angled toward said axially facing side of the blade structure; and a portion of said second wing flange adjacent to said radially outer edge includes a component that is angled toward said axially facing side of the blade structure.

8. The seal assembly according to claim 6, wherein:

said radially outer side of said wing member defines a smooth, curved transition from said axially facing side of the blade structure to said first wing flange; and said radially outer side of said wing member defines a smooth, curved transition from said second surface of said first wing flange to said curved first surface of said second wing flange.

9. The seal assembly according to claim 6, wherein said central region is further defined by said concave first surface of said second wing flange, and wherein said concave first surface of said second wing flange limits a passage of working gas from said central region through said radial second gap and into an inner region adjacent said central region by recirculating at least a portion of said working gas in said central region away from said radial second gap and back toward said radial first gap.

10. The seal assembly according to claim 9, wherein:

said radially inwardly facing side of said annular inner shroud comprises a first radially inwardly facing surface and a second radially inwardly facing surface;

said second wing flange extends radially outwardly further than said first wing flange; and said first radially inwardly facing surface of said annular inner shroud is located radially inward from said second radially inwardly facing surface of said annular inner shroud such that a stepped portion is formed in said annular inner shroud between said first and second radially inwardly facing surfaces and located in said central region.

11. The seal assembly according to claim 10, wherein said central region comprises:

a first central recirculation zone radially outwardly from said radial first gap and defined by said second radially inwardly facing surface of said annular inner shroud, said stepped portion of said annular inner shroud, and said concave first surface of said second wing flange, said first central recirculation zone effecting recirculating flow in a first direction;

a second central recirculation zone radially inward from said first central recirculation zone and said radial first gap, said second central recirculation zone defined by said second surface of said first wing flange, said radially outer side of said wing member, and said concave first surface of said second wing flange said second central recirculation zone effecting recirculating flow in a second direction opposite to said first direction; and wherein said stepped portion of said annular inner shroud defines a central region boundary that distinguishes said first central recirculation zone from said second central recirculation zone.

12. The seal assembly according to claim 11, wherein:

said concave first surface of said second wing flange limits a passage of working gas from said first central recirculation zone through said radial second gap and into said inner region by recirculating at least a portion of said working gas in said first central recirculation zone in said first direction radially outwardly and back toward said radial first gap; and said concave first surface of said second wing flange limits a passage of working gas from said second central recirculation zone through said radial second gap and into said inner region by recirculating at least a portion of said working gas in said second central recirculation zone in said second direction radially inwardly and back toward said radial first gap.

13. The seal assembly according to claim 9, further comprising an axial shroud flange associated with said inner region and extending from an axially facing side of said annular inner shroud toward said wing member, wherein said axial shroud flange is located proximate to said wing member such that a throat region having a dimension in an axial direction is formed between said axial shroud flange and said wing member.

14. The seal assembly according to claim 13, wherein:

said radially inner side of said wing member comprises a curved radially inner side having a convex surface that faces said axially facing side of said annular inner shroud;

said inner region is defined by said axially facing side of said annular inner shroud, said axial shroud flange, and said curved radially inner side of said wing member; and said axial shroud flange limits a passage of working gas from said inner region through said axial third gap and into said disc cavity by recirculating at least a portion of said working gas in said inner region away from said throat region and back toward said radial second gap.

15. The seal assembly according to claim 14, wherein said inner region comprises:

a first inner recirculation zone defined by a curved surface of said axially facing side of said annular inner shroud, said axial shroud flange, and said curved radially inner side of said wing member; and a second inner recirculation zone radially inward from said first inner recirculation zone, said second inner recirculation zone defined by said axially facing side of said annular inner shroud and a radially inwardly facing side of said axial shroud flange.

16. The seal assembly according to claim 15, wherein said curved radially outer edge of said axial shroud flange limits a passage of working gas in said first inner recirculation zone through said throat region by recirculating at least a portion of said working gas in said first inner recirculation zone radially inwardly and then axially back toward said radial second gap.

17. A seal assembly that limits gas leakage from a hot gas path to one or more disc cavities in a gas turbine engine comprising a plurality of stages, each stage comprising a plurality of stationary components and a disc structure supporting a blade structure comprising a row of airfoils for rotation on a turbine rotor, the seal assembly comprising:

a seal apparatus that limits gas leakage from the hot gas path to a disc cavity associated with an axially facing side of the blade structure, said seal apparatus comprising:

an annular inner shroud associated with adjacent stationary components, said annular inner shroud comprising a radially inwardly facing side, a radially outwardly facing side, and an axially facing side;

a wing member extending axially from said axially facing side of the blade structure toward said annular inner shroud, said wing member including a radially inner side and a radially outer side;

a first wing flange extending radially outwardly from said radially outer side of said wing member toward said radially inwardly facing side of said annular inner shroud, said first wing flange being curved in a radial direction and having a concave first surface facing said axially facing side of the blade structure and a second surface opposed from its concave first surface that faces away from said axially facing side of the blade structure, wherein a radially outer edge of said first wing flange is located proximate to said radially inwardly facing side of said annular inner shroud such that a radial first gap having a dimension in the radial direction is formed between said first wing flange and said radially inwardly facing side of said annular inner shroud;

a second wing flange axially spaced apart from said first wing flange and extending radially outwardly from said radially outer side of said wing member toward said radially inwardly facing side of said annular inner shroud, said second wing flange being curved in the radial direction and having a concave first surface facing said axially facing side of the blade structure and a second surface opposed from its concave first surface and facing away from said axially facing side of the blade structure, wherein a radially outer edge of said second wing flange is located proximate to said radially inwardly facing side of said annular inner shroud such that a radial second gap having a dimension in the radial direction is formed between said second wing flange and said radially inwardly facing side of said annular inner shroud; and an axial shroud flange extending from said axially facing side of said annular inner shroud toward said wing member, wherein said axial shroud flange is located proximate to said wing member such that a throat region having a dimension in an axial direction is formed between said axial shroud flange and said wing member.

18. The seal assembly according to claim 17, further comprising:

an outer region defined radially inwardly from the hot gas path between said axially facing surface of the blade structure, said annular inner shroud, said radially outer side of said wing member, and said concave first surface of said first wing flange;

a central region adjacent said outer region and defined between said wing member, said radially inwardly facing side of said annular inner shroud, said second surface of said first wing flange, and said concave first surface of said second wing flange;

an inner region adjacent said central region and opposed from said outer region, said inner region defined by said axially facing side of said annular inner shroud, said axial shroud flange, and said wing member; and wherein:

said concave first surface of said first wing flange limits a passage of working gas from said outer region through said radial first gap into said central region by recirculating at least a portion of said working gas in said outer region away from said radial first gap and back toward the hot gas path;

said concave first surface of said second wing flange limits a passage of working gas from said central region through said radial second gap into said inner region by recirculating at least a portion of said working gas in said central region away from said radial second gap and back toward said radial first gap; and said axial shroud flange limits a passage of working gas from said inner region through said throat region and into said disc cavity by recirculating at least a portion of said working gas in said inner region away from said disc cavity and back toward said radial second gap.

19. The seal assembly according to claim 18, wherein:

said radially inwardly facing side of said annular inner shroud comprises a first radially inwardly facing surface and a second radially inwardly facing surface;

said second wing flange extends radially outwardly further than said first wing flange; and said first radially inwardly facing surface of said first annular inner shroud is located radially inward from said second radially inwardly facing surface of said annular inner shroud such that a stepped portion is formed in said annular inner shroud between said first and second radially inwardly facing surfaces.

20. The seal assembly according to claim 19, wherein:

said outer region is defined between an outer boundary and an inner boundary, said outer boundary defined by a steam line extending from an outer surface of a platform of the blade structure adjacent said airfoils to a portion of said radially outwardly facing side of said annular inner shroud adjacent said stationary components;

said outer region comprises:

a first outer recirculation zone defined radially inwardly from said outer boundary between said axially facing surface of the blade structure and a portion of said radially outer side of said annular inner shroud having a radial component, said first outer recirculation zone effecting recirculating flow in a first direction; and a second outer recirculation zone defined radially inwardly from said first outer recirculation zone, said second outer recirculation zone defined between said axially facing surface of the blade structure, said concave first surface of said first wing flange, and said inner boundary defined by said radially outer side of said wing member, said second outer recirculation zone effecting recirculating flow in a second direction opposite said first direction; said central region comprises:

a first central recirculation zone radially outwardly from said radial first gap and defined by said second radially inwardly facing surface of said annular inner shroud, said stepped portion of said annular inner shroud, and said concave first surface of said second wing flange;

a second central recirculation zone radially inward from said first central recirculation zone and said radial first gap, said second central recirculation zone defined by said second surface of said first wing flange, said radially outer side of said wing member, and said concave first surface of said second wing flange; and wherein said stepped portion of said annular inner shroud defines a central region boundary that distinguishes said first central recirculation zone from said second central recirculation zone and wherein said first and second central recirculation zones comprise respective oppositely moving recirculation flows;

said inner region comprises:

a first inner recirculation zone defined by a curved surface of said axially facing side of said annular inner shroud, said axial shroud flange, and said radially inner side of said wing member, wherein said radially inner side of said wing member comprises a curved radially inner side having a convex surface that faces said axially facing side of said annular inner shroud; and a second inner recirculation zone radially inward from said first inner recirculation zone, said second inner recirculation zone defined by said axially facing side of said annular inner shroud and a radially inwardly facing side of said axial shroud flange.

* * * * *